US007044106B2

(12) United States Patent
Kojima et al.

(10) Patent No.: US 7,044,106 B2
(45) Date of Patent: May 16, 2006

(54) SUCTION AIR NEGATIVE PRESSURE DETECTING APPARATUS OF THROTTLE BODY

(75) Inventors: Yoji Kojima, Kawasaki (JP); Kunihiko Maeda, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/226,336

(22) Filed: Sep. 15, 2005

(65) Prior Publication Data

US 2006/0060167 A1 Mar. 23, 2006

(30) Foreign Application Priority Data

Sep. 17, 2004 (JP) ..... 2004-270819

(51) Int. Cl.
*F02D 9/08* (2006.01)

(52) U.S. Cl. ..... 123/337; 123/195 A

(58) Field of Classification Search ..... 123/337, 123/399, 195 R, 195 A, 195 C; 73/118.2
See application file for complete search history.

(56) References Cited

U.S. PATENT DOCUMENTS 4,519,369 A * 5/1985 Kitamura ..... 123/337
6,341,593 B1 * 1/2002 Kamimura et al. ..... 123/337
6,412,471 B1 * 7/2002 Trublowski et al. ..... 123/399
6,470,739 B1 * 10/2002 Matsumura et al. ..... 73/118.2
6,845,656 B1 * 1/2005 Matsumura et al. ..... 73/118.2

* cited by examiner

*Primary Examiner*—Hai Huynh
(74) *Attorney, Agent, or Firm*—Bacon & Thomas PLLC

(57) ABSTRACT

To inhibit rotation of a sensor case by excessive rotational force applied thereto, a suction air negative pressure detecting apparatus is structured such that a regular polygonal shaped positioning convex portion is provided on a case containing a pressure sensor, a positioning concave hole having apex angle concave portions at a multiple number of apex angle convex portions of a regular polygon forming the positioning convex portion is provided in a flat-shaped pressure plate arranged on the case, the positioning concave hole is engaged with the positioning convex portion, and the pressure plate is fixed by screw to a throttle body, the case is fixed toward the throttle body by the pressure plate, and a rotation of the case is inhibited by engaging the positioning convex portion with the positioning concave hole.

2 Claims, 4 Drawing Sheets

SUCTION AIR NEGATIVE PRESSURE DETECTING APPARATUS OF THROTTLE BODY

TECHNICAL FIELD

The present invention relates to a suction air negative pressure detecting apparatus of a throttle body detecting a suction air negative pressure within a suction air passage by a pressure sensor, in a fuel injection apparatus in which a fuel within a fuel tank is boosted by a fuel pump and the fuel is injected and supplied to an engine via a fuel injection valve.

BACKGROUND ART

A description will be given of a suction air negative pressure detecting apparatus of a throttle body in accordance with a prior art with reference to FIGS. 8 and 9.

FIG. 8 is a top plan view showing a state in which a pressure sensor is attached to a throttle body.

FIG. 9 is a vertical sectional view of a main portion along a line A—A in FIG. 8.

Reference numeral 30 denotes a throttle body in which a suction air passage 31 is provided so as to penetrate sideways. The suction air passage 31 is opened and closed by a butterfly type throttle valve 33 fixed by screw to a throttle valve shaft 32 rotatably supported to the throttle body 30.

Reference symbol S denotes a pressure sensor replacing a pressure change within the suction air passage 31 to a voltage change so as to detect. The pressure sensor S is constituted by a pressure conversion element such as a silicon diaphragm or the like, and a hybrid IC amplifying an output signal of the pressure conversion element, and a suction air negative pressure within the suction air passage 31 is introduced to one side of the silicone diaphragm via a negative pressure introduction hole Sa.

The pressure sensor S mentioned above is shown in Japanese Unexamined Patent Publication No. 8-261080.

The pressure sensor S is fixedly arranged within a sensor case 34 by a potting member P formed by a synthetic resin material, and the sensor case 34 is open toward a lower side.

The sensor case 34 is provided with a cylindrical wall portion 34*a*, a cylinder portion 34*b* protruding further toward an upper side from an upper bottom portion 34*d* and a connector portion 34*c* in which a terminal 35 is arranged in a protruding manner, and the negative pressure introduction hole Sa of the pressure sensor S is arranged so as to be open toward a lower side while facing to an inner side of the cylindrical wall portion 34*a*.

Further, a terminal Sb in a sensor side extending to a side portion from the pressure sensor S is electrically connected to an inner end of the terminal 35 by soldering or the like.

On the other hand, a cylinder boss portion 30*a* to which the cylinder wall portion 34*a* of the sensor case is rotatably inserted is formed in the throttle body 30 so as to protrude toward an upper side, and a downstream side of a negative pressure introduction hole 35 for the sensor is open to a concave portion in an upper end of the cylinder boss portion 30*a*.

An upstream side of the sensor negative pressure introduction hole 35 is open toward the suction air passage 31 in a downstream side of a throttle valve 33.

In this case, a suction air passage 31*a* in the downstream side of the throttle valve communicates with an engine (not shown), and a suction air passage 31*b* in an upstream side of the throttle valve 33 communicates with an air cleaner (not shown).

Further, the pressure sensor S attached to the sensor case 34 mentioned above is fixed to the throttle body 30 in the following manner.

First, an inner periphery of the cylinder wall portion 34*a* of the sensor case 34 is arranged so as to be inserted to an outer periphery of the cylinder boss portion 30*a* of the throttle body 30. At this time, an O-ring 36 is provided in a compression manner with respect to an outer periphery of the inner peripheral boss portion 30*a* of the cylinder wall portion 34*a*.

Accordingly, the inner periphery of the cylinder wall portion 34*a* and the outer periphery of the cylinder boss portion 30*a* are held in an airtight manner by the O-ring 36.

Secondly, the sensor case 34 is screwed and fixed to the throttle body 30 by a pressure plate 37. The pressure plate 37 is formed in a flat plate shape, and a case insertion hole 37*a* inserting the cylinder portion 34*b* of the sensor case 34 and a screw insertion hole 37*b* for inserting a screw are provided in the pressure plate 37, (in which the sensor insertion hole 37*a* is formed in a segmental circular shape).

Further, the pressure plate 37 is arranged on the upper bottom portion 34*d* of the sensor case 34, the cylinder portion 34*b* of the sensor case 34 is inserted to the case insertion hole 37*a*, the pressure plate 37 is arranged on an upper end surface of an attachment boss 30*b* protruding to an upper side of the throttle body 30, and the screw 38 is screwed into the attachment boss 30*b* via the screw insertion hole 37*b* of the pressure plate 37 in this state. Accordingly, the sensor case 34 provided with the pressure sensor S is pressure fixed toward the throttle body 30 by the pressure plate 37.

Therefore, a negative pressure generated within the intake passage 31*a* is introduced into the pressure sensor S via the sensor negative pressure introduction hole 35 and the negative pressure introduction hole Sa, and the pressure sensor S outputs a voltage signal corresponding to the negative pressure toward an external portion via a sensor side terminal Sb and a terminal 35.

DISCLOSURE OF THE INVENTION

Problem to be Solved by the Invention

In accordance with the conventional suction air negative pressure detecting apparatus mentioned above, since the cylinder wall portion 34*a* of the sensor case 34 is arranged so as to be inserted to the cylinder boss portion 30*a* of the throttle body 30, the connector portion 34*c* can be freely arranged toward a rotational direction of 360 degree.

However, since the sensor case 34 is fixed to the throttle body 30 only by fixing a flat portion of the pressure plate 37 pressing and fixing the upper bottom portion 34*d* of the sensor case 34, there is a risk that the connector portion 34*c* rotates at a time when an excessive rotational force is applied to the connector portion 34*c*.

Further, in accordance with the rotation of the connector portion, positions of a female connector fitted and connected to the connector portion 34*c* and a lead wire extending from the female connector (in which the female connector and the lead wire are not illustrated) are changed from initial set positions, and they are undesirably interfered with the other constituting parts such as a throttle lever, an accelerator wire, an opening degree sensor and the like connected to the throttle body 30.

Further, when inserting the cylinder wall portion 34*a* of the sensor case 34 to the cylinder boss portion 30*a*, arranging the case insertion hole 37*a* of the pressure plate 37 so as to face to the cylinder portion 34*b* of the sensor case 34, and screwing the pressure plate 37 toward the attachment boss 30*b* by the screw 38 in the state mentioned above, it is impossible to inhibit the rotation of the sensor case 34 until the pressure plate 37 is completely attached to the attachment boss 30*b* by the screw 38.

In accordance with the structure mentioned above, a positioning jig for inhibiting the rotation of the sensor case 34 is required at a time of a screwing work of the pressure plate 37.

Further, when attaching the pressure plate 37 by the screw 38, a rotational force around the screw 38 is applied to the pressure plate 37. Accordingly, the sensor case 34 is exposed to the rotational force to the side portion around the screw 38, so that there is fear that the O-ring 36 is biased so as to generate a defective airtightness between the inner peripheral wall 34*a* and the cylinder boss portion 30*a*, or a strain is applied to the pressure sensor S so as to give an adverse effect to an output characteristic.

A suction air negative pressure detecting apparatus of a throttle body in accordance with the present invention is made by taking the problems mentioned above into consideration, and a first object of the present invention is to provide a suction air negative pressure detecting apparatus which can inhibit a rotation of a sensor case even if an excessive rotational force is applied to the sensor case provided with a pressure sensor.

Further, a second object of the present invention is to provide a suction air negative pressure detecting apparatus which well keeps a sealing property of an O-ring for airtightness arranged between a cylinder boss portion of a throttle body and a cylinder wall portion of a sensor case and prevents a strain from being generated in a pressure sensor arranged in a sensor case, at a time of fixing by screw the sensor case to the throttle body by means of a pressure plate.

Means for Solving the Problem

In order to achieve the objects mentioned above, in accordance with a first aspect of the present invention, there is provided a suction air negative pressure detecting apparatus of a throttle body in which a pressure sensor is arranged within a sensor case, an output signal from the pressure sensor is output via a terminal protruding to an inner side of a connector portion of the sensor case, a cylinder wall portion of the sensor case is arranged so as to be rotatably inserted to a cylinder boss portion protruding from the throttle body and the sensor case is pressure fixed by a pressure plate screwed to the throttle body, wherein a positioning convex portion formed in a regular polygonal shape is provided in an upper bottom portion of the sensor case, a positioning concave portion having apex angle concave portions at a multiple number of apex angle convex portions of the regular polygon forming the positioning convex portion is provided in the pressure plate, the pressure plate is arranged on the upper bottom portion of the sensor case, the positioning concave hole is arranged so as to be engaged with the positioning convex portion of the sensor case, and the pressure plate is fixed by screw to the throttle body.

Further, in accordance with a second aspect of the present invention, in addition to the first aspect mentioned above, a rotation preventing portion inhibiting a rotation of the pressure plate is provided in the pressure plate, and the rotation preventing portion is locked to the throttle body.

Effect of the Invention

In accordance with the first aspect of the present invention, the cylinder wall portion of the sensor case provided with the pressure sensor is arranged so as to be inserted to the cylinder boss portion of the throttle body via the O-ring.

In the state mentioned above, the pressure plate is arranged on the upper bottom portion of the sensor case in a contact manner, the positioning concave hole of the pressure plate is arranged so as to be engaged with the positioning convex portion of the sensor case, and in this state, the pressure plate is fixed to the throttle body by the screw.

In accordance with the structure mentioned above, the sensor case is pressure fixed toward the throttle body by the pressure plate, and the rotation of the sensor case is inhibited on the basis of the engagement of the positioning convex portion with the positioning concave hole.

In this case, since the positioning convex portion of the sensor case is formed in the regular polygonal shape, and the positioning concave hole of the pressure plate is formed by the apex angle concave portions at the multiple number of the regular polygonal apex angle convex portions forming the positioning convex portion, it is possible to rotationally arrange the sensor case in correspondence to the number of the apex angle concave portion.

Further, since the rotation of the sensor case is inhibited by the positioning concave hole of the pressure plate in which the positioning convex portion is firmly fixed to the throttle body at a time when the rotational force is applied to the sensor case, it is possible to prevent the sensor case from being rotate, and it is possible to always maintain the opening position of the connector portion at the initial set position.

Further, the sensor case can be previously arranged at a predetermined rotational angle position, and the positioning concave hole of the pressure plate is arranged so as to be engaged with the positioning convex portion of the sensor case in this state.

Accordingly, since the rotation of the sensor case is inhibited so as to execute the screwing work at a time when fixing the pressure plate to the throttle body by the screw, the positioning jig for positioning and holding the sensor case is not required.

Further, the positioning convex portion may be additionally provided in the upper portion of the conventional sensor case, and the positioning concave hole can be obtained by changing the shape of the case insertion hole in the conventional pressure plate. Accordingly, no special part is required additionally and it is possible to extremely easily obtain the structure in comparison with the conventional one.

Further, in accordance with the second aspect of the present invention, in the pressure plate pressing and fixing the sensor case, since the rotation preventing portion formed in the pressure plate is locked to the throttle body, the pressure plate does not rotate around the screw at a time of attaching the pressure plate to the throttle body by the screw, and the pressure plate dose not apply the sideway rotational load to the pressure sensor.

In accordance with the structure mentioned above, the O-ring arranged in a compressed manner between the cylinder wall portion of the sensor case and the cylinder boss portion of the throttle body is not biased and the seal property between the cylinder wall portion and the cylinder boss portion is not impeded, so that it is possible to accurately introduce the negative pressure generated within the suction air passage in the downstream side of the throttle valve from the sensor negative pressure introduction hole toward the negative pressure introduction hole of the pressure sensor.

Further, since no external force is applied to the pressure sensor arranged within the sensor case, and no strain is generated in the pressure sensor, the pressure sensor can output an accurate voltage signal corresponding to the negative pressure introduced from the negative pressure introduction hole from the terminal.

BEST MODE FOR CARRYING OUT THE INVENTION

A description will be given below of an embodiment of a suction air negative pressure detecting apparatus of a throttle body in accordance with the present invention with reference to the accompanying drawings.

A description will be given of an embodiment of a pressure sensor used in the present invention with reference to FIGS. 1 and 2.

Figure 1:
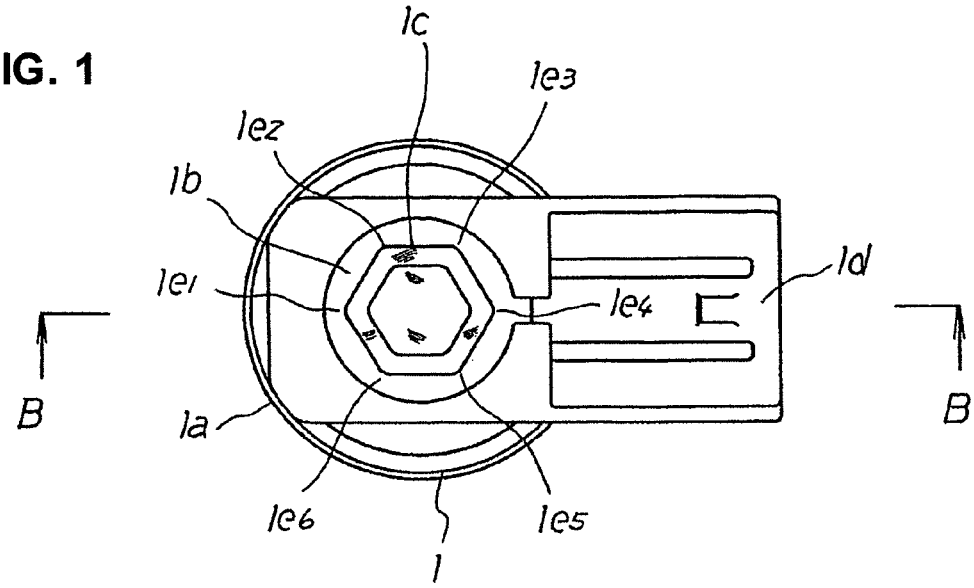
FIG. 1 is a top plan view of a pressure sensor used in a suction air negative pressure detecting apparatus in accordance with the present invention.
Figure 2:
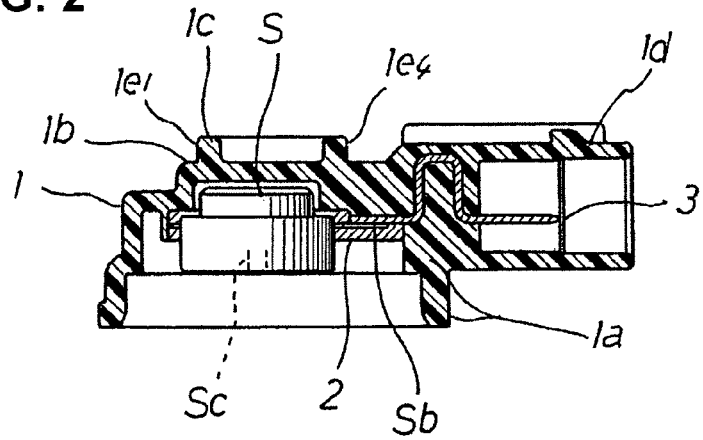
FIG. 2 is a vertical sectional view along a line B—B in FIG. 1.

FIG. 1 is a top plan view of a pressure sensor. FIG. 2 is a vertical sectional view along a line B—B in FIG. 1.

Reference numeral 1 denotes a sensor case in which the pressure sensor S mentioned above is arranged so as to be fixed to an inner portion thereof by a potting member 2 made of a synthetic resin material.

The sensor case 1 is formed such that a cylinder wall portion 1*a*, in which a large-diameter hole and a small-diameter hole are continuously provided toward a lower side, is open toward a lower side, and a positioning convex portion 1*c* constituted by a regular polygon is formed so as to protrude toward an upper side.

In the present embodiment, the positioning convex portion 1*c* is formed in a regular hexagonal shape. Accordingly, the positioning convex portion 1*c* has six apex angle convex portions 1*e*1, 1*e*2, . . . , 1*e*6.

Further, a connector portion 1*d* is formed toward a side portion in the sensor case 1, and a sensor side terminal Sb extending from the pressure sensor S is electrically connected to an inner end of a terminal 3 protruding into the connector portion 1*d* in accordance with soldering or the like.

In this case, the pressure sensor is arranged so as to face to a lower side of the sensor case 1, and a negative pressure introduction hole Sc facing to one side of a silicon diaphragm (not shown) arranged within the pressure sensor S is open to a lower surface of the pressure sensor S.

Figure 3:
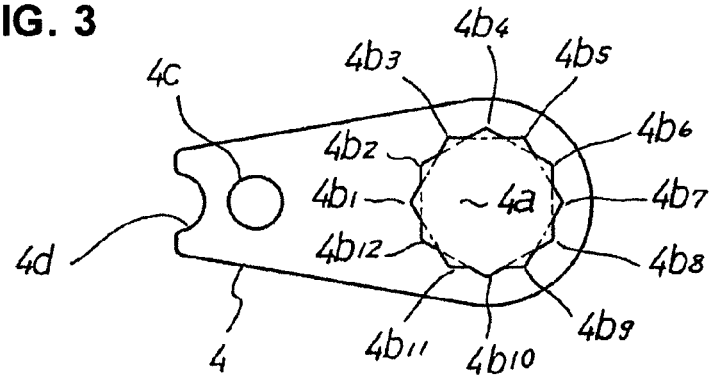
FIG. 3 is a top plan view of a pressure plate used in the suction air negative pressure detecting apparatus in accordance with the present invention.

Next, a description will be given of the pressure plate 4 pressure fixing the sensor case 1 toward the throttle body with reference to FIG. 3.

The pressure plate 4 is formed in a flat plate shape, a positioning concave hole 4*a* is provided in a right side in the drawing, and a screw insertion hole 4*c* is provided in a left side.

The positioning concave hole 4*a* is formed in the following manner.

The positioning concave hole 4*a* is formed in a hole shape with which the positioning convex portion 1*c* is arranged so as to be engaged, and is provided with apex angle concave portions 4*b* to which the apex angle convex portions 1*e* of the positioning convex portion 1*c* are inserted. The apex angle concave portions 4*b* are formed at a multiple number of the apex angle convex portions 1*e* of the positioning convex portion 1*c*.

Accordingly, the positioning convex portion 1*c* in accordance with the present embodiment is formed in a regular hexagonal shape, and has six apex angle convex portions 1*e*1, . . . , 1*e*6, and the apex concave portions 4*b* of the pressure plate 4 is constituted by twelve apex angle concave portions 4*b*1, 4*b*2, . . . , 4*b*12 corresponding to twice of six.

In other words, when forming the regular hexagonal positioning concave hole 4*a* having six apex angle concave portions 4*b*1, 4*b*3, 4*b*5, 4*b*7, 4*b*9 and 4*b*11 by shifting the regular hexagonal positioning concave hole 4*a* having six apex angle concave portions 4*b*2, 4*b*4, 4*b*6, 4*b*8, 4*b*10 and 4*b*12 formed including a dotted line by 30 degree as shown by a single-dot chain line, it is possible to form the positioning concave hole 4*a* provided with twelve apex angle concave portions 4*b*1, . . . , 4*b*12.

Further, the sensor case 1 provided with the pressure sensor S is fixed by screw to the throttle body 5 by the pressure plate 4 in the following manner.

A description will be given with reference to FIGS. 4 and 5.

Figure 4:
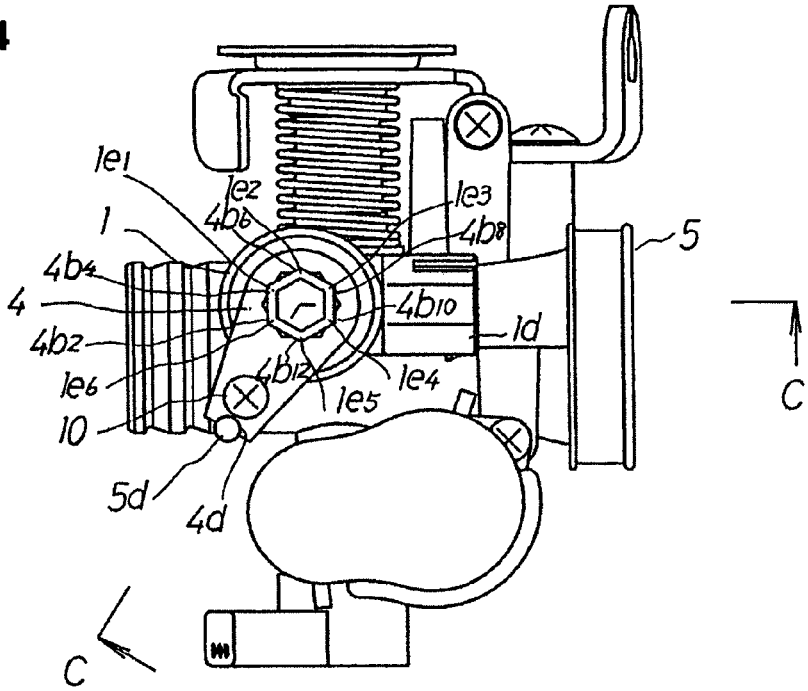
FIG. 4 is a top plan view of the suction air negative pressure detecting apparatus in accordance with the present invention, in a state in which a sensor case is fixed by screw to a throttle body.

FIG. 4 is a top plan view showing a state in which the sensor case 1 is fixed by screw to the throttle body 5. FIG. 5 is a vertical sectional view of a main portion along a line C—C in FIG. 4.

The throttle body 5 is provided such that a suction air passage 6 penetrates an inner portion, and a butterfly type throttle valve 7 controlling so as to open and close the suction air passage 6 is attached to a throttle valve shaft 8 rotatably supported to the throttle body 5.

Further, in one side of the throttle body 5, there is formed a cylinder boss portion 5*a* to which a cylinder wall portion 1*a* constituted by a large-diameter hole and a small-diameter hole of the sensor case 1 is inserted, and in which a large-diameter tube portion and a small-diameter tube portion are continuously provided, so as to protrude toward an upper side, and there is formed an attachment boss 5*c* in which a female thread hole 5*b* is provided in a side portion so as to be open toward an upper end, in such a manner as to protrude toward an upper side.

In this case, reference numeral 6 denotes a negative pressure introduction hole for the sensor. An upstream side of the sensor negative pressure introduction hole 6 is open to an inner side of a suction air passage 6*a* in a downstream side of the throttle valve 7, and a downstream side is open toward an upper end 5*a*1 of the cylinder boss portion 5*a*.

Further, the cylinder wall portion 1*a* of the sensor case 1 is arranged so as to be inserted toward the cylinder boss portion 5*a* of the throttle body 5, and an annular O-ring 9 is arranged in a compressed manner between an outer periphery 5*a*2 of the cylinder boss portion 5*a* and an inner periphery 1*a*1 of the cylinder wall portion 1*a* at this time.

When inserting the sensor case 1 to the throttle body 5, the connector portion 1*d* of the sensor case 1 can be arranged approximately at a predetermined position in accordance with a visual observation.

Next, the pressure plate 4 is arranged on the upper bottom portion 1*b* of the sensor case 1 arranged so as to be inserted to the throttle body 5 in accordance with the manner mentioned above and is arranged on the upper end 5*c*1 of the attachment boss 5*c* of the throttle body 5, and the positioning concave hole 4*a* of the pressure plate 4 is arranged so as to be engaged with the positioning convex portion 1*c* of the sensor case 1 at this time. In other words, six apex angle convex portions 1*e*1, . . . , 1*e*6 of the positioning convex portion 1*c* of the sensor case 1 are arranged so as to be engaged with six apex angle concave portions 4*b*2, 4*b*4, 4*b*6, 4*b*8, 4*b*10 and 4*b*12 forming the regular hexagon in the positioning concave hole 4*a*.

Further, in the state mentioned above, a screw 10 is engaged with the female thread hole 5*b* open to the upper end 5*c*1 of the attachment boss 5*c* via the screw insertion hole 4*c* of the pressure plate 4.

In accordance with the structure mentioned above, since the upper bottom portion 1*b* of the sensor case 1 is pressure held by the pressure plate 4, the sensor case 1 is inhibited from breaking away to the upper side. Further, since the positioning convex portion 1*c* formed in the regular hexagonal shape is arranged so as to be engaged with the positioning concave hole 4*a* having the corresponding apex angel concave portions 4*b*, the rotation of the sensor case 1 is inhibited. Further, the pressure sensor S arranged within the sensor case 1 is shielded from the ambient air by the O-ring 9 provided in the compressed manner between the cylinder wall portion 1*a* and the cylinder boss portion 5*a*. Accordingly, the negative pressure generated within the suction air passage 6*a* in the downstream side of the throttle valve 7 is introduced into the pressure sensor S via the sensor negative pressure introduction hole 6 and the negative pressure introduction hole Sc, and it is possible to output the voltage signal corresponding to the negative pressure via the sensor side terminal Sb and the terminal 3, for example, toward an external ECU (not shown).

In this case, in accordance with the present invention, since the positioning convex portion 1*c* of the sensor case 1 is formed in the regular polygonal shape, and the apex angle concave portions 4*b*1, . . . , 4*b*12 constituted by the multiple number of the regular polygonal apex angle convex portions 1*e*1, . . . , 1*e*6 of the positioning convex portion 1*c* are provided in the positioning concave hole 4*a* provided in the pressure plate 4, it is possible to attach the sensor case 1 by rotating the sensor case 1 in correspondence to the number of the apex angle concave portions 4*b*1, . . . , 4*b*12.

In the present embodiment, since the positioning convex portion 1*c* is formed in the regular hexagonal shape, and twelve apex angle concave portions 4*b*1, 4*b*12 corresponding to the multiple number of the apex angle convex portions 1*e*1, . . . , 1*e*6 are provided in the positioning hole 4*a* of the pressure plate 4, it is possible to select twelve positions of the sensor case 1 in the rotational direction every 30 degree in the rotational direction.

Accordingly, it is possible to freely set the position of the connector portion 1*d* of the sensor case 1 in the rotational direction in the same manner as the conventional one.

Further, in accordance with the present invention, since a plurality of apex angle convex portions 1*e*1, . . . , 1*e*6 of the positioning convex portion 1*c* are arranged so as to be engaged with a plurality of apex angle concave portions 4*b*2, 4*b*4, 4*b*6, 4*b*8, 4*b*10 and 4*b*12 of the pressure plate 4, the sensor case 1 does not rotate at a time when the excessive rotational force is applied to the sensor case 1, and it is possible to always maintain the connector portion 1*d* of the sensor case 1 at the initial set position.

Further, since the sensor case 1 is engaged with the pressure plate 4 by a plurality of apex angle convex portions and a plurality of apex angle concave portions, the external force applied to the sensor case 1 does not intensively act on one position but is dispersed to the respective apex angle convex portions. Accordingly, it is possible to inhibit the sensor case 1 from being broken at a time of being exposed to the rotational force.

Further, since the positioning concave portion 4*a* of the pressure plate 4 is arranged so as to be engaged with the positioning convex portion 1*c* of the sensor case 1, and the sensor case 1 is prevented from being rotated on the basis of the engagement between the positioning concave hole 4*a* and the positioning convex portion 1*c* at a time of attaching the pressure plate 4 to the throttle body 5 by the screw 10 in this state, the positioning jig for inhibiting the sensor case 1 itself from rotating is not required at a time of the screwing work of the pressure plate 4, and it is possible to reduce an equipment cost.

Figure 5:
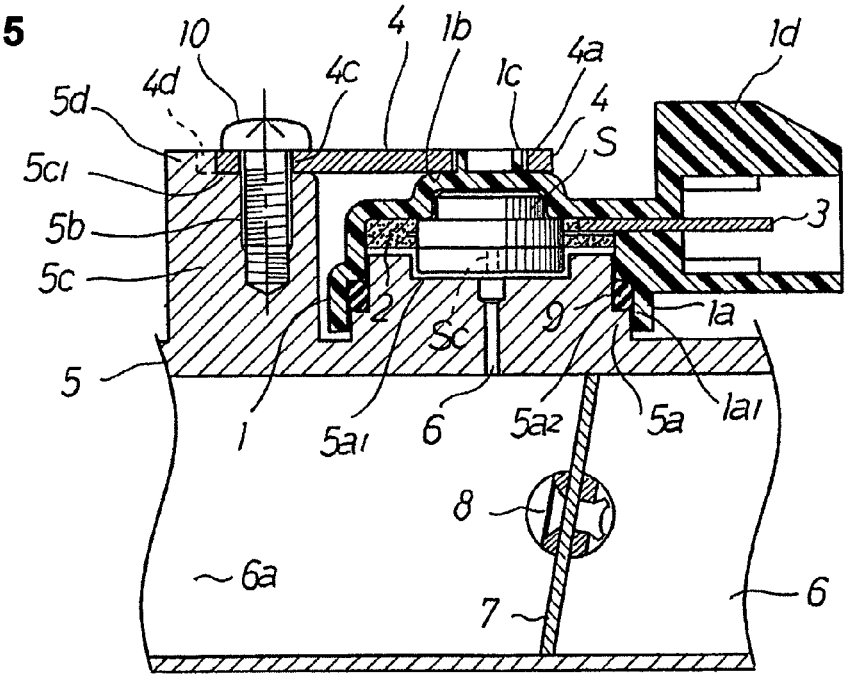
FIG. 5 is a vertical sectional view of a main portion along a line C—C in FIG. 4.

Further, since the O-ring 9 is arranged between the inner periphery of the cylinder wall portion 1*a* of the sensor case 1 and the outer periphery of the cylinder boss portion 5*a* of the throttle body 5, it is possible to omit the position at which the sensor case 1 and the throttle body 5 are brought into contact with each other in the fastening direction of the pressure plate 4 (a vertical direction in FIG. 5). Accordingly, no large pressure force is applied to the sensor case 1, so that the output voltage is not changed by distortion of the pressure sensor S.

A description will be given of the pressure plate 4 by turning back to FIG. 3. Reference symbol 4*d* denotes a rotation preventing portion which is provided in a left side of the screw insertion hole 4*c* and is formed in a segmental circular shape open to an outer side. The rotation preventing portion 4*d* is locked by a regulating lever portion 5*d* formed so as to protrude to the upper end 5*c*1 of the attachment boss 5*c* at a time of attaching the pressure plate 4 to the upper end 5*c*1 of the attachment boss 5*c* of the throttle body by the screw 10.

In accordance with the structure mentioned above, it is possible to inhibit the rotation of the pressure plate around the screw 10 at a time of attaching the pressure plate 4 to the attachment boss 5*c* of the throttle body 5 by the screw 10.

Accordingly, since the sideway pressing force is not applied to the sensor case 1 from the pressure plate 4, the O-ring 9 is not compressed to one side, and the airtightness between the inner periphery of the cylinder wall portion 1*a* and the outer periphery of the cylinder boss portion 5*a* is not deteriorated.

Further, since no external force is applied to the pressure sensor S from the sensor case 1, it is possible to well maintain the output characteristic from the pressure sensor S.

Figure 6:
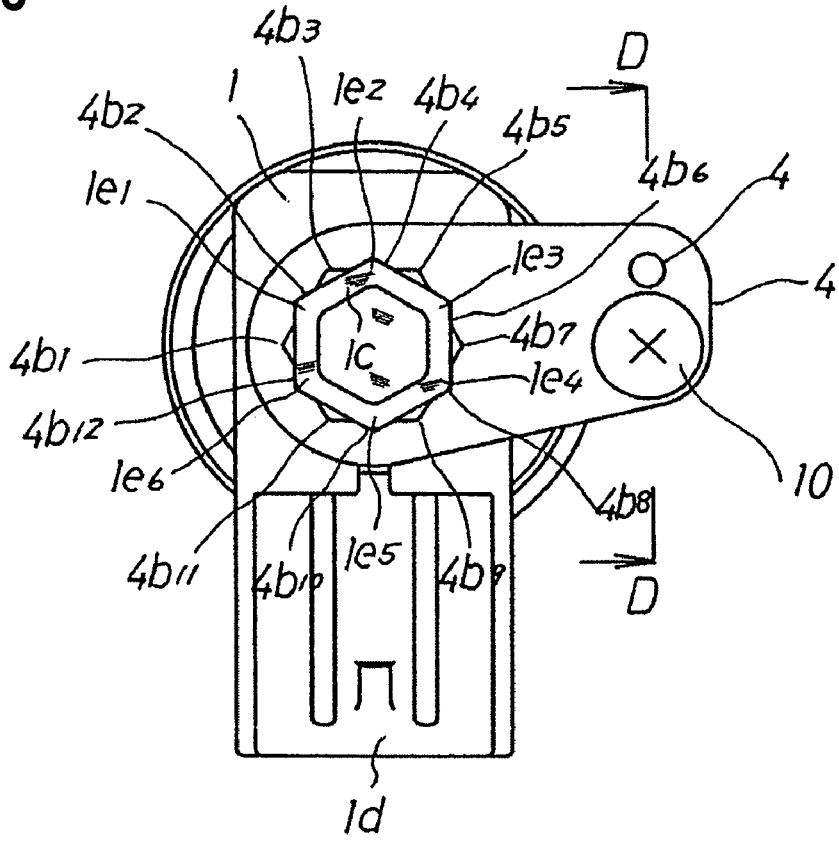
FIG. 6 is a top plan view of a main portion showing another embodiment in which the sensor case is pressure fixed toward the throttle body by a pressure plate.
Figure 7:
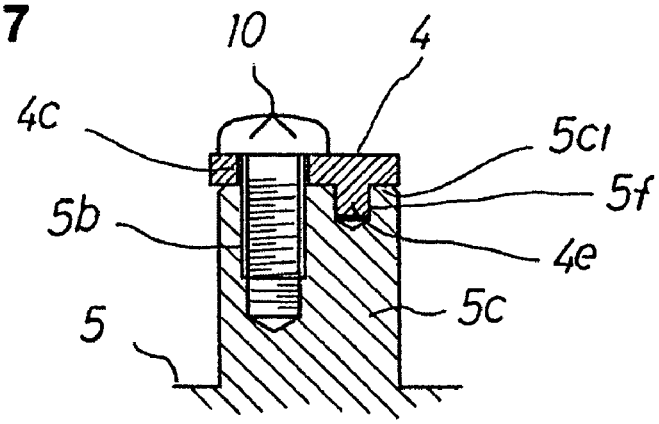
FIG. 7 is a vertical sectional view of a main portion along a line D—D in FIG. 6.
Figure 8:
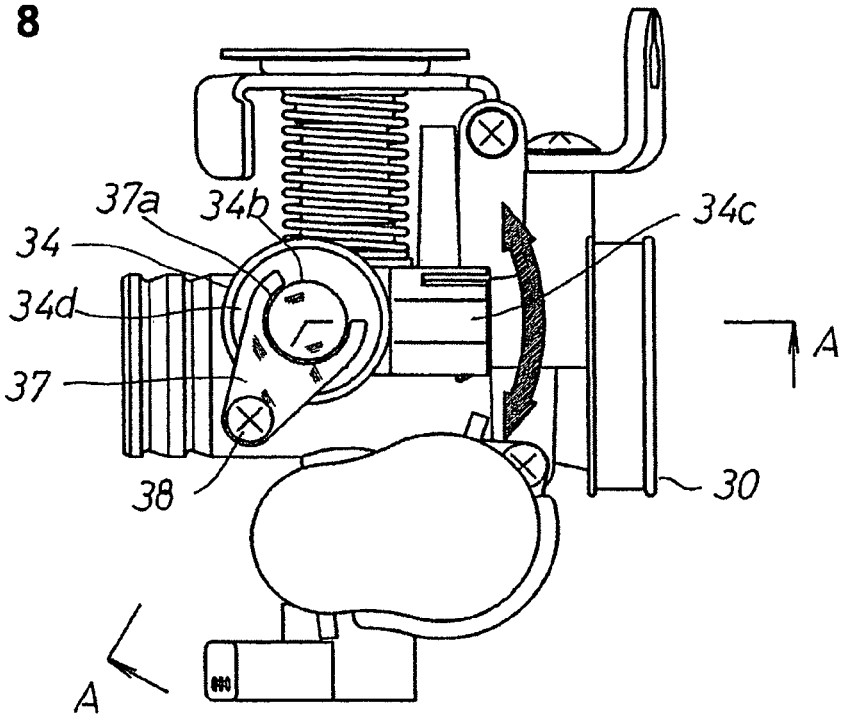
FIG. 8 is a top plan view showing a conventional suction air negative pressure detecting apparatus.
Figure 9:
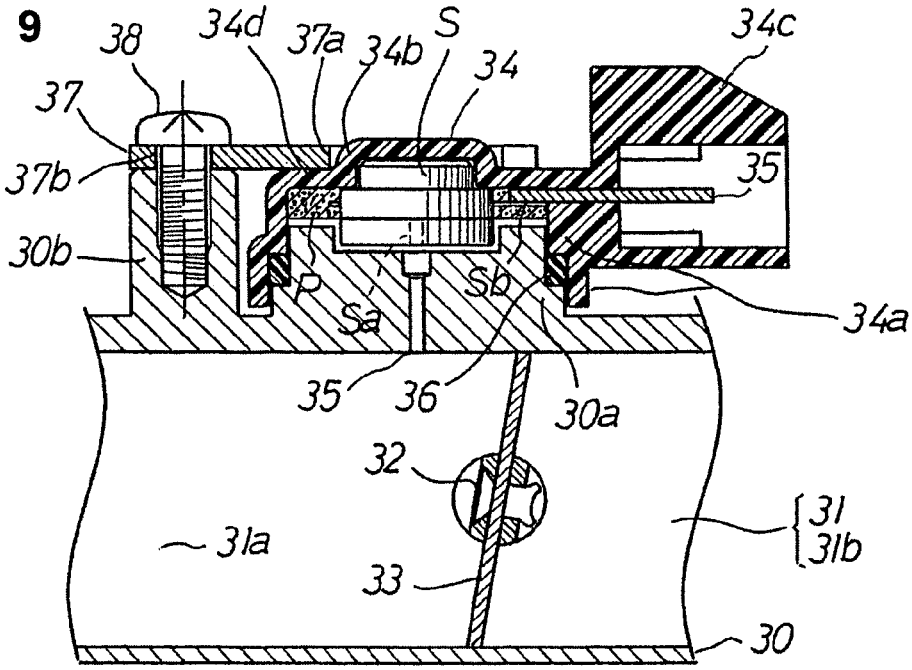
FIG. 9 is a vertical sectional view of a main portion along a line A—A in FIG. 8.

FIGS. 6 and 7 show another embodiment of the rotation preventing portion.

FIG. 6 is a top plan view of a main portion showing a state in which the sensor case is pressure fixed toward the throttle body by the pressure plate. FIG. 7 is a vertical sectional view of a main portion along a line D—D in FIG. 6.

The rotation preventing portion 4*e* formed in the pressure plate 4 is formed so as to protrude toward a lower side from a lower surface of the pressure plate 4 in accordance with an embossing process.

Further, the rotation preventing portion 4*e* is arranged so as to be engaged within an engagement hole 5*f* provided in the upper end 5*c*1 of the attachment boss 5*c*, whereby it is possible to inhibit the rotation of the pressure plate 4 at a time of screwing the pressure plate 4.

In this case, the regular polygonal shape of the positioning convex portion 1*c* is not limited to the regular hexagonal shape, but may be constituted by a regular octagonal shape, a regular square shape or a regular triangular shape.

What is claimed is:

1. A suction air negative pressure detecting apparatus of a throttle body in which a pressure sensor is arranged within a sensor case, an output signal from the pressure sensor is output via a terminal protruding to an inner side of a connector portion of the sensor case, a cylinder wall portion of said sensor case is arranged so as to be rotatably inserted to a cylinder boss portion protruding from the throttle body and the sensor case is pressure fixed by a pressure plate screwed to the throttle body, wherein a positioning convex portion formed in a regular polygonal shape is provided in an upper bottom portion of the sensor case, a positioning concave portion having apex angle concave portions at a multiple number of apex angle convex portions of the regular polygon forming said positioning convex portion is provided in the pressure plate, said pressure plate is arranged on the upper bottom portion of the sensor case, the positioning concave hole is arranged so as to be engaged with the positioning convex portion of the sensor case, and the pressure plate is fixed by screw to the throttle body.

2. A suction air negative pressure detecting apparatus of a throttle body as claimed in claim 1, wherein a rotation preventing portion inhibiting a rotation of the pressure plate is provided in said pressure plate, and said rotation preventing portion is locked to the throttle body.

* * * * *